US006685114B2

(12) United States Patent
Okamoto et al.

(10) Patent No.: US 6,685,114 B2
(45) Date of Patent: Feb. 3, 2004

(54) ELECTROMAGNETIC FUEL INJECTION VALVE

(75) Inventors: Yoshio Okamoto, Minori (JP); Yuzo Kadomukai, Ishioka (JP); Makoto Yamakado, Tsuchiura (JP); Noriyuki Maekawa, Chiyoda (JP); Tohru Ishikawa, Kitaibaraki (JP); Ayumu Miyajima, Chiyoda (JP); Kiyoshi Amou, Chiyoda (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/096,496

(22) Filed: Mar. 13, 2002

(65) Prior Publication Data

US 2002/0088880 A1 Jul. 11, 2002

Related U.S. Application Data

(63) Continuation of application No. 09/650,092, filed on Aug. 29, 2000, now Pat. No. 6,367,720.

(30) Foreign Application Priority Data

Sep. 20, 1999 (JP) ..... 11-265006

(51) Int. Cl.[7] ..... B05B 1/30; F02M 51/00

(52) U.S. Cl. ..... 239/585.1; 239/585.2; 239/585.3; 239/585.4; 239/585.5

(58) Field of Search ..... 239/585.1, 585.2, 239/585.3, 585.4, 585.5, 533.2, 533.9, 91; 251/127, 129.15, 129.21

(56) References Cited

U.S. PATENT DOCUMENTS

| | | | | | |
|---|---|---|---|---|---|
| 2,721,100 | A | | 10/1955 | Bodine, Jr. | 299/25 |
| 4,718,386 | A | * | 1/1988 | Gieles | 123/472 |
| 4,934,605 | A | * | 6/1990 | Hans et al. | 239/585.4 |
| 5,044,563 | A | * | 9/1991 | Mesenich | 239/585.4 |
| 5,098,016 | A | | 3/1992 | Okamoto et al. | 239/585.1 |
| 5,190,223 | A | * | 3/1993 | Mesenich | 239/585.5 |
| 5,288,025 | A | | 2/1994 | Cerny | 239/533.8 |
| 5,295,627 | A | | 3/1994 | Wahba | 239/585.4 |
| 5,375,323 | A | | 12/1994 | Sata | 29/888.1 |
| 5,428,883 | A | | 7/1995 | Stieglitz | 29/602.1 |
| 5,544,816 | A | * | 8/1996 | Nally et al. | 239/585.5 |
| 5,685,493 | A | | 11/1997 | Grytz et al. | 239/585.1 |
| 5,755,386 | A | | 5/1998 | Lavan et al. | 239/585.4 |
| 5,820,032 | A | | 10/1998 | Reiter | 239/585.1 |
| 5,979,786 | A | * | 11/1999 | Longman et al. | 239/58 |

FOREIGN PATENT DOCUMENTS

| | | |
|---|---|---|
| JP | 10122085 | 5/1998 |

* cited by examiner

*Primary Examiner*—Davis Hwu
(74) *Attorney, Agent, or Firm*—Antonelli, Terry, Stout & Kraus, LLP

(57) ABSTRACT

A valve structure which works easily, does not increase production cost, can reduce dispersion in a side gap by restricting eccentricity and incline of a valve body and can maintain highly accurate injection. An electromagnetic fuel injection valve is required which is easy to manufacture even in a narrow valve structure. A guide portion is provided having one end fixed to an injection valve main body for guiding the valve member. A nozzle guide body constituting a magnetic passage portion to surround a magnetic member connected and fixed to one end of the valve member by the same material is provided. Accordingly, it is possible to reduce dispersion of a side gap constituting the magnetic passage, and it is also possible to stabilize an axial motion of the valve member, whereby high injection accuracy is maintained and an inexpensive injection valve is obtained.

13 Claims, 3 Drawing Sheets

ELECTROMAGNETIC FUEL INJECTION VALVE

This is a continuation of parent application Ser. No. 09/650,092, filed Aug. 29, 2000 now U.S. Pat. No. 6,367, 720, the entire disclosure of which is hereby incorporated by reference.

BACKGROUND OF THE INVENTION

1. Field of the Invention

The present invention relates to an electromagnetic fuel injection valve which is used in an internal combustion engine and which drives a valve body due to an electromagnetic force to inject fuel.

2. Description of the Prior Art

In an electromagnetic operating type injection valve described in Japanese Patent Unexamined Publication No 10-122085, a valve body is constituted by a valve closing body 10 connected to the end portion of a connection tube 11 by welding and a movable element 12, and is guided by a guide flange 15 provided in an intermediate member 6. On the contrary, a magnetic passage is constituted by a fuel inflow tube piece 1, serving as a core surrounded by an electromagnetic coil 4, at least one guide element 16, serving as a ferromagnetic element formed as a yoke, a connection member 14, brought into contact with another end portion of the guide element 16, and the movable element 12. At this time, a gap portion (a void portion in a direction crossing a valve axis (in a diametrical direction) is formed between an outer peripheral surface of the movable element 12 and an inner peripheral surface of the connection member 14, and a side magnetic passage (referred to as a side gap in the present invention) is formed in the gap portion.

In the electromagnetic fuel injection valve in accordance with the conventional structure, in order to restrict a dispersion in the side gap, it is necessary to secure a coaxiality between the intermediate member 6 and the connection member 14, and also a coaxiality between a seat surface of a seat body 8 and the connection member 14 It is also necessary when assembling the parts to secure both of them with a high accuracy. Accordingly, a working process becomes difficult and the cost therefore becomes expensive. These problems become significant as the injection valve becomes narrower, and, as a result, it becomes difficult to keep the required working accuracy. It also becomes difficult to maintain the required injection accuracy due to an eccentricity and an incline of the valve body which occur in the conventional structure.

SUMMARY OF THE INVENTION

The present invention was made to solve the disadvantages mentioned above, and an object of the present invention is to provide a valve structure that works easily, does not increase production cost, can reduce a dispersion in a side gap by restricting an eccentricity and an incline of a valve body, and can maintain a high injection accuracy high.

An electromagnetic fuel injection valve in accordance with the present invention has a gap portion (i.e., a side gap portion) in a direction crossing a valve axis (in a diametrical direction) in a magnetic passage for driving a valve body In accordance with the present invention, the structure is made such that the gap portion and a guide portion for guiding a movement in a direction of the valve axis of the valve body are constructed within the same member (one member). That is, the member corresponds to a member provided in an outer peripheral portion of the valve body along the valve axis, and the member may be a nozzle body in which a fuel injection hole and a valve seat are formed or the member may be an independent member for supporting the nozzle body, for example, a nozzle guide body.

DESCRIPTION OF THE PREFERRED EMBODIMENTS

Figure 1:
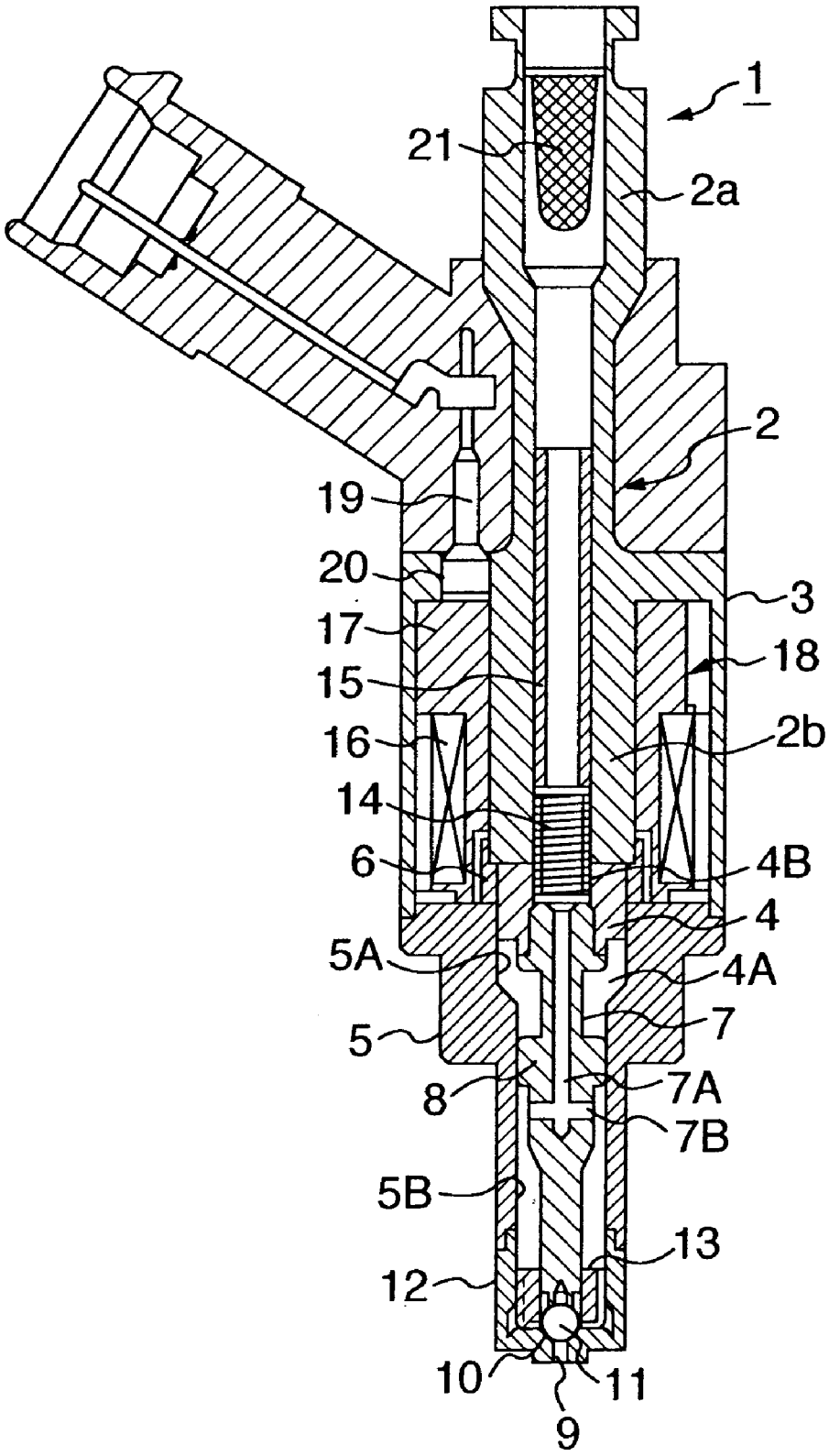
FIG. 1 is a vertical cross sectional view of a fuel injection valve which shows an embodiment in accordance with the present invention.

A description will be given below of an embodiment in accordance with the present invention with reference to FIGS. 1 and 2.

At first, a description will be given of a structure of a fuel injection valve 1 with reference to FIG. 1. FIG. 1 is a vertical cross sectional view of the fuel injection valve 1 which shows an embodiment in accordance with the present invention.

The electromagnetic fuel injection valve 1 opens and closes a seat portion in accordance with an ON-OFF signal of a duty calculated by a control unit in order to inject fuel. A magnetic circuit has a fuel introduction portion 2*a*, and is constituted by a core 2 having a column portion 2*b* extending in an axial direction in a center portion thereof, a bottomed cylindrical yoke 3, connected and fixed to the core 2, a plunger 4 opposing to the core 2 at an interval, and a nozzle guide body 5 having an inner diameter expanding portion in such a manner as to surround the plunger 4. An end surface outer peripheral portion of the column portion 2*b* in the core 2, and an end surface inner peripheral portion of the nozzle guide portion 5 are provided with a seal ring 6 for mechanically connecting and fixing each of them, thereby preventing fuel from flowing out to a coil 16 side. Further, the seal ring 6 is formed by a nonmagnetic material, so as not to serve as a magnetic passage.

The coil 16 exciting the magnetic circuit is wound around a bobbin 17. However, since the fuel is prevented by the seal ring 6 from flowing into the coil side, a comparatively inexpensive structure can be obtained only by taking an insulating property into consideration. A terminal 19 of a coil assembly 18, structured in the manner mentioned above is inserted into a hole 20 provided in the bottomed portion of the yoke 3. The terminal 19 is connected to a terminal of a control unit (not shown).

A hole 4B for inserting and holding a spring 14, corresponding to an elastic member pressing a movable valve 4A comprising a plunger 4 and a rod 7 connected to the plunger 4 by welding to a seat surface 10 disposed on the upstream side of a fuel injection hole 9, formed in a nozzle body 12 and allowing the fuel to pass through is provided at the center of the column portion 2*b* in the core 2. An upper end of the spring 14 is brought into contact with a lower end of a spring adjuster 15 inserted into the center of the core 2 for adjusting a set load. Further, a nozzle guide body 5 is welded to a free end of the yoke 3 by welding.

The movable valve 4A is constituted by the plunger 4, made of a magnetic material and the rod 7 having one end bonded welded the plunger 4. However, a hollow portion 7A constituting a fuel passage is provided in an inner portion of the plunger 4 side of the rod 7. The hollow portion 7A has a fuel outflow port 7B below (in the downstream side) a portion in which an outer diameter of the rod 7 is expanded (hereinafter, referred to as an expanded portion). Further, an outer periphery of the expanded portion 8 is brought into contact with an inner wall surface of a portion 5B, in which an inner diameter of the nozzle guide body 5 is reduced (hereinafter, referred to as a contracted portion), whereby an axial motion of the movable valve 4A is guided. The nozzle body 12 having the seat surface 10 and the fuel injection hole 9 which allows the fuel to pass through and is disposed at the center of the seat surface 10 is inserted into the end surface side of the contracted portion 5B of the nozzle guide body 5 so as to be mechanically bonded thereto. A stroke (i.e., the amount of movement necessary to reach an axial upper portion) of the movable valve 4A is determined in accordance with the height of the nozzle body 12. As a method of adjusting the height, it can be considered to control sizes in level of parts. However, in order to use the parts for a mass production with no loss, a shim may be inserted between the nozzle guide body 5 and the nozzle body 12.

Here, reference numeral 21 denotes a filter. The filter 21 is provided for preventing dusts or foreign materials in the tube from entering to the seat side during a combustion.

A description will now be given in detail of the structure and function of the nozzle guide body 5 and the nozzle body 12, connected and fixed to the nozzle guide body 5 in accordance with the present embodiment, and the structure of the fuel passage with reference to FIG. 2.

Figure 2:
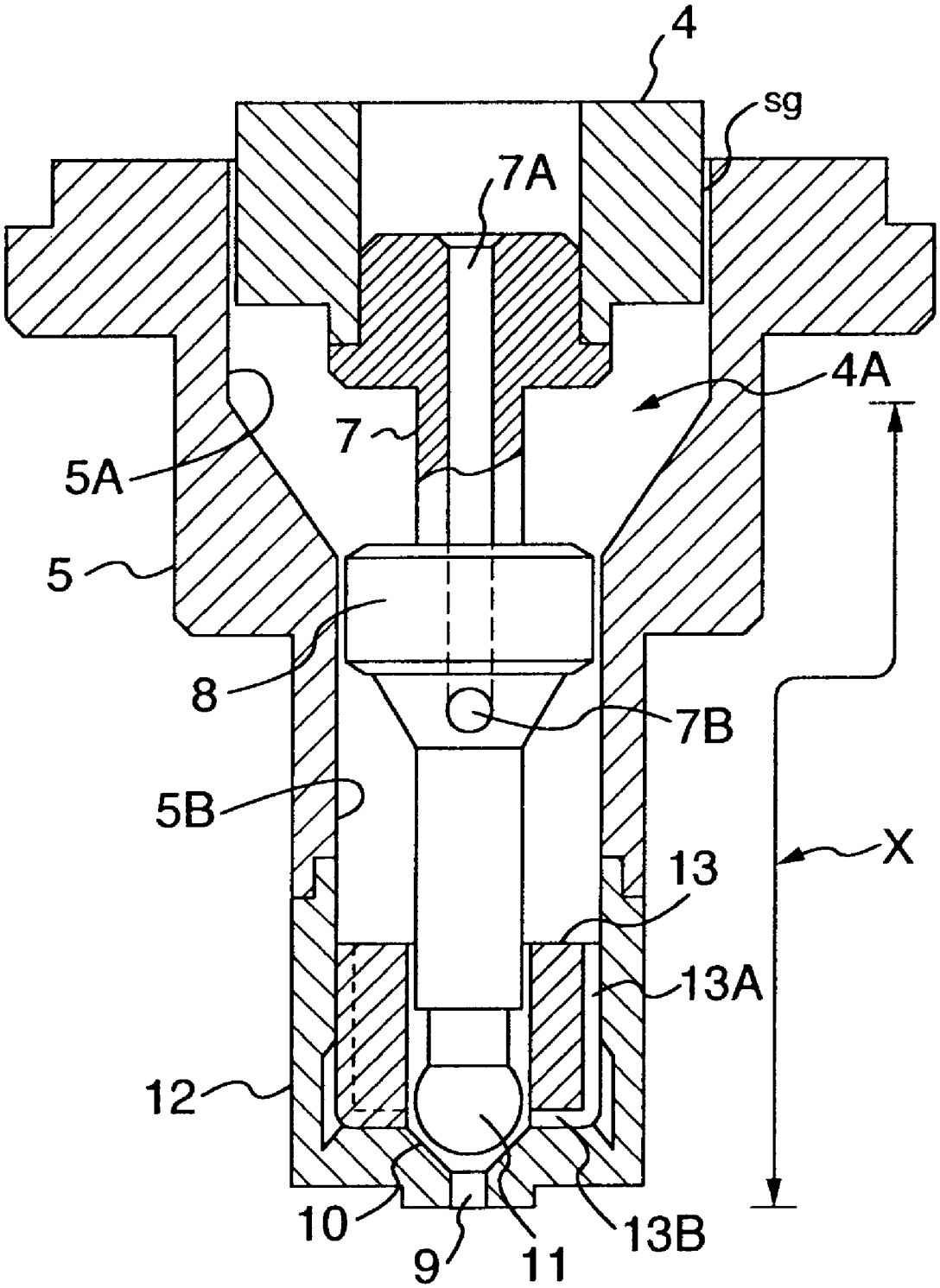
FIG. 2 is an enlarged cross sectional view in a periphery of a front end portion of the fuel injection valve.

FIG. 2 is a vertical cross sectional view of a main portion and shows the valve portion in an enlarged manner. The nozzle guide body 5 has an inner diameter expanded portion 5A and a contracted portion 5B. The plunger 4 is opposed to the inner diameter expanded portion 5A, and a side gap sg, constituting a magnetic passage, is formed between an inner wall 10 surface of the inner diameter expanded portion 5A and an outer peripheral surface of the plunger 4. On the contrary, the expanded portion 8 of the rod 7, connected to the plunger 4, is coaxially opposed to the inner diameter contracted portion 5B, and an axial motion of the movable valve 4A is guided by the expanded portion. Further, the nozzle body 12 is connected and fixed to the end of the inner diameter contracted portion 5B, and a cylindrical fuel swirling member 13 is mechanically fixed within the nozzle body 12. In accordance with the fuel swirling member 13, the seat surface 10 and the fuel injection hole 9 are integrally formed in the nozzle body 12. A ball 11 corresponding to a valve closing body is welded to the front end portion of the rod 7. An outer peripheral surface of the ball 11 is coaxially connected to an inner diameter side of the fuel swirling member 13 at a small interval, thereby assisting in guiding the axial motion of the movable valve 4A.

In accordance with the structure mentioned above, the side gap sg, corresponding to the magnetic passage formed between the plunger 4 and the inner diameter expanded portion 5A of the nozzle guide body 5, is produced in order to have a significantly reduced dispersion and high accuracy. That is, since the guiding portion of the nozzle guide body 5 opposing the expanded portion 8 of the rod 7, and the inner diameter expanded portion 5A in which the side gap sg is formed are disposed within the same member, it becomes easy to work the elements while keeping the coaxiality of the elements at a high accuracy (in accordance with the same working procedure, that is, the member does not require any change of clamping). Further, since no accurate work in accordance with a combination of the parts is required, the accuracy is not reduced, even in the case of a narrow valve body. Accordingly, since an accurate work can be easily performed, the structure can be inexpensively produced and the size dispersion due to a mass production can be restricted, so that a mass production can be performed. In this case, in the nozzle guide body 5, a high frequency induction hardening is applied to the contracted portion 5B side, except at the inner diameter expanded portion 5A. A hardening is applied to the range of an X portion shown in FIG. 2. This hardened portion increases the hardness of the portion for guiding the movable valve 4A and reduces the function generated by a sliding operation between the contracted portion 5B and the expanded portion 8 of the rod 7.

Returning to FIG. 1, a description will be given of a motion of the fuel injection valve 1 in accordance with the present invention.

The fuel injection valve 1 drives the movable valve 4A in accordance with an electrical ON-OFF signal, which is applied to the electromagnetic coil 16 in order to open and close the seat surface 10, thereby controlling the fuel injection. When the electrical signal is applied to the coil 16, a magnetic circuit is formed in the core 2, the yoke 3, the plunger 4, and the nozzle guide body 5, and the plunger 4 is sucked to the core 2*b* side. When the plunger 4 is moved, the movable valve 4A integrally formed therewith is also moved in order to be apart from the seat surface 10 in the seat of the nozzle body 12, and open the fuel injection hole 9. The fuel is pressurized and adjusted via a fuel pump (not shown) and a regulator for adjusting a fuel pressure. The fuel then flows into an inner portion of the fuel injection valve 1 from the filter 21, and flows downward via the outflow port 7B from the hollow portion 7A, provided in the movable valve 4A. Thereafter, the fuel is sufficiently rectified before reaching an upstream side of the fuel swirling member 13, provided in the nozzle body 12, and moves to the fuel injection hole 8 disposed downstream via an axial passage 13A and a diametrical passage 13B of the fuel swirling member 13. At this time, the fuel is eccentrically introduced from the axial center by the diametrical passage 13B. That is, a swirling motion is applied to the fuel and the fuel is introduced to the fuel injection hole 9, whereby the fuel is atomized and injected.

Figure 3:
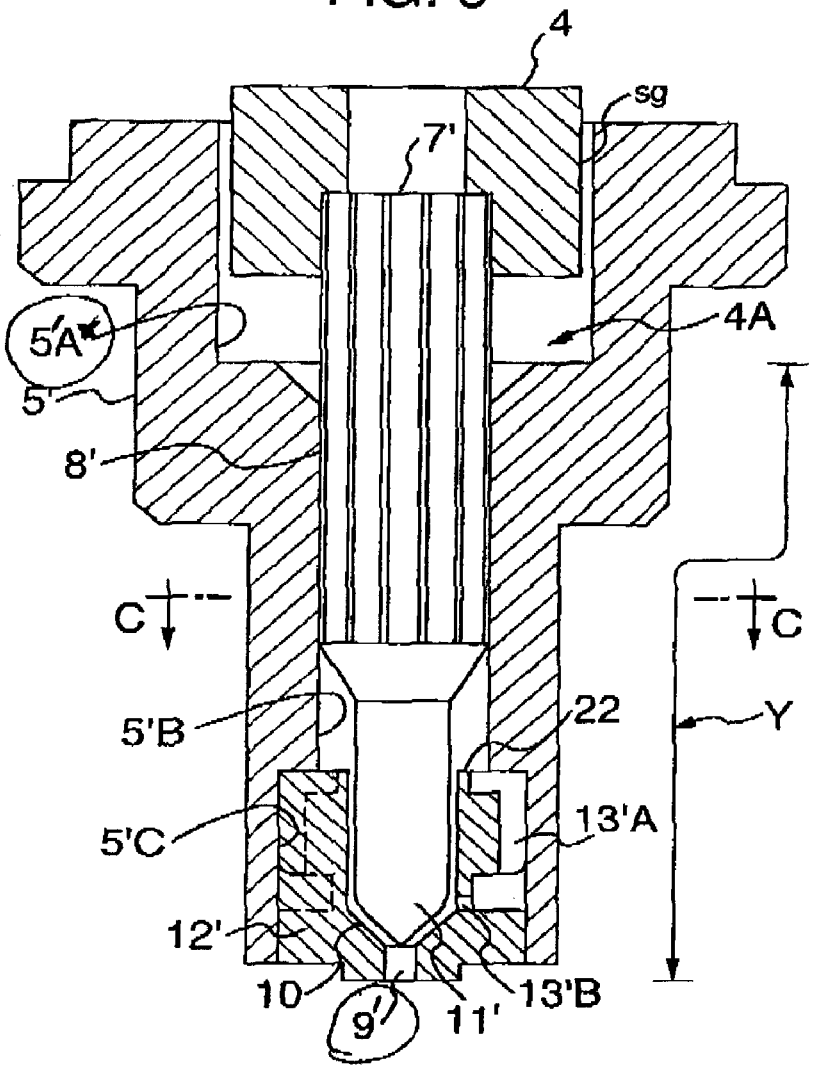
FIG. 3 is an enlarged cross sectional view in a periphery of a front end portion which shows another embodiment.
Figure 4:
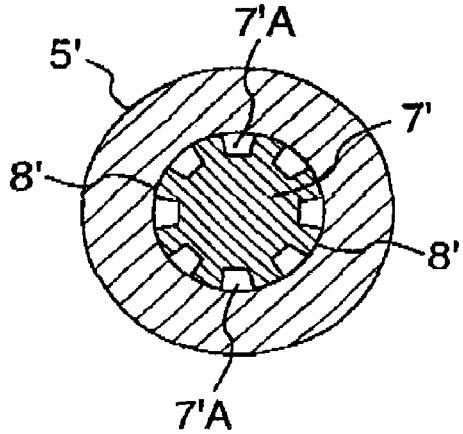
FIG. 4 is a cross sectional view taken along a direction of C in FIG. 3.

Next, a description will be given of another embodiment in accordance with the present invention, with reference to FIGS. 3 and 4. FIG. 3 is a vertical cross sectional view of the main portion in which a valve 10 portion is enlarged, and FIG. 4 is a cross sectional view taken along a direction of C in FIG. 3.

A description will be given of the structure and an of operation with reference to respective drawings.

In the present embodiment, a rod 7', connected and fixed to the plunger 4, is produced by a drawn material. In this case, since dimensional accuracy can be secured by grinding an outer shape, an inexpensive movable valve 4'A can be provided. Further, the valve closing body is not formed in a ball shape and has a spherical surface connected to a contracted portion of the rod 7', and is thereby constituted by a spherical surface conical valve 11, obtained by closing in order to form a conical shape in subsequent to the spherical R surface. Accordingly, since no mechanical fixing means such as welding or the like are added, an inexpensive structure can be provided. A nozzle guide body 5' has an inner diameter expanded portion 5'A, a contracted portion 5'B. The plunger 4 is opposed to the inner diameter expanded portion 5'A, and a side gap sg constituting a magnetic passage is formed. Further, a guide hole opposing to the rod 7' portion is formed in the contracted portion 5'B, and a nozzle 12' is inserted and fixed to the expanded portion 5'C.

In the structure mentioned above, a dispersion of the side gap sg constituting the magnetic passage, can be restricted by securing coaxiality between the guide hole opposing to the rod 7' portion and the inner diameter expanded portion 5'A of the nozzle guide body 5'. That is, since the guide hole which guides the valve body and the inner diameter expanded portion 5'A constituting the side gap sg are constructed with the same material, an accurate working process can be easily performed. A nozzle body 12' has a fuel inflow passage 22, an axial passage 13'A communicating with the inflow passage 22, a diametrical passage 13'B, and is integrally provided with a seat surface 10 for the spherical surface conical valve 11', corresponding to the valve closing body and a fuel injection hole 9' in a downstream portion thereof. In this case, also in the present embodiment, a high-frequency induction hardening is applied to the contracted portion 5'B side in the nozzle guide body 5', except at the inner diameter expanded portion 5'A. A hardening is applied to the range of a Y portion, shown in FIG. 3. This hardened portion increases the hardness of the portion which guides the movable valve 4'A and reduces a friction generated by a sliding operation between the contracted portion 5'B and the expanded portion 8' of the rod 7'.

The pressurized fuel flows into the nozzle body 12, from a plurality of recess-shaped axial passages 7'A (illustrated in FIG. 4 and communicating between the inner diameter expanded portion 5'A and the 10 contracted portion 5'B) formed in the rod 7'. However, the fuel which is sufficiently rectified before reaching the nozzle body 12' flows downstream from the axial passage 13'A via the diametrical passage 13'B. At this time, the fuel is eccentrically introduced from the axial center by the diametrical passage 13'B. That is, a swirling force is applied to the fuel, and the fuel is introduced to the fuel injection hole 9', whereby an atomization of the fuel is promoted and the fuel is injected.

In this case, an axial moving amount of the rod 7' constituting the valve body is determined by the height of the nozzle body 12' also in the present embodiment. However, in order to reduce the dispersion of the size, it is possible to insert a shim between the nozzle body 12' and the nozzle guide body 5' in order to provide adjustments to reduce dispersion.

The embodiment mentioned above can be easily produced in the case of being applied to a fuel injection valve in which a nozzle body having a small diameter and that is formed in a narrow shape is required, and a great advantage can be obtained.

In the former embodiment, the nozzle guide body 5 and the nozzle body 12 may be constructed as shown in the present embodiment. Further, in place of the ball valve 11, the spherical surface conical valve 11 may be employed.

In the two embodiments mentioned above, in order to work a coaxiality between the guide portion which guides the rod and the inner wall surface forming the side gap at a high accuracy and in an easy manner, it is necessary that these elements are within the same member, so that the nozzle guide body and the nozzle body 12 may be constituted by the same member.

As mentioned above, in accordance with each of the embodiments mentioned above, in the fuel injection valve having the fuel passage, in which the fuel is communicated, is formed in an inner portion, the valve member for opening and closing the fuel passage, the valve seat portion with which the valve member is brought into contact at the time of closing the fuel passage, and in the fuel injection hole allowing the fuel to pass through in the downstream side of the valve seat portion, there is provided at least one guide portion which is one end fixed to the injection valve main body and guides the axial sliding motion of the valve member in the inner portion. Further, the nozzle guide body constituting the magnetic passage portion is formed in order to surround the magnetic member connected and fixed to one end of the valve member by the same material. Accordingly, it is possible to reduce dispersion of the side gap constituting the magnetic passage by restricting the eccentricity and the incline of the valve member. It is possible to stabilize the axial motion of the valve member and it is also possible to maintain high injection accuracy. In particular, even in the narrow valve structure, the injection accuracy is not lowered. Further, since the working process is performed within the same member, the accurate working process can be easily realized, and the inexpensive production can be achieved and a mass production can be performed.

Since the guide portion which guides the axial sliding motion of the valve member and the member surrounding the magnetic member connected and fixed to the valve member in order to form the magnetic passage are provided within the same member, it is possible to restrict the eccentricity and the incline of the valve member, and it is possible to reduce the dispersion of the side gap constituting the magnetic passage. Accordingly, it is also possible to stabilize the axial motion of the valve member and to maintain high injection accuracy as well.

What is claimed is:

1. An electromagnetic fuel injection valve for driving a valve body having a valve closing portion being in contact with or apart from a valve seat and a magnetic passage portion forming a magnetic passage by an electromagnetic force, comprising:

a guide member guiding said valve body, wherein said guide member is comprised of a guide portion being in contact with said valve body and guiding said valve body in a driving direction, and an opposing portion opposing to said magnetic passage portion with a gap, and, wherein a magnetic circuit is formed by said magnetic passage portion, said gap and the opposing portion of said guide member.

2. An electromagnetic fuel injection valve as claimed in claim 1, wherein said guide portion and said opposing portion are formed in said guide member in an axial direction of said valve body, and said guide portion and said opposing portion are formed apart from each other in said axial direction.

3. An electromagnetic fuel injection valve as claimed in claim 1 or 2, wherein a guide surface comprising said guide portion and an opposing surface comprising said opposing portion are formed in said guide member.

4. An electromagnetic fuel injection valve as claimed in claim 1, wherein said guide member is provided with an opening for inserting said valve body in one end portion in an axial direction of said valve body, and has said valve seat and a fuel injection hole in a downstream side of the valve seat in another end portion.

5. An electromagnetic fuel injection valve as claimed in claim 4, wherein said valve seat and said fuel injection hole are formed as part of a separate member from said guide member, and the member is integrally fixed to said guide member.

6. An electromagnetic fuel injection valve as claimed in claim 5, wherein an assembly obtained by integrally fixing said guide member to the member forming said valve seat and the fuel injection hole is integrally fixed to an assembly having a coil and a core so as to comprise an electromagnet.

7. An electromagnetic fuel injection valve according to claim 1 wherein said guide member comprises a unitary nozzle guide body.

8. An electromagnetic fuel injection valve according to claim 7 wherein said guide portion and said opposing portion are formed adjacent to one another in said guide member.

9. An electromagnetic fuel injection valve according to claim 8 wherein said opposing portion is formed in an area of said guide member having larger internal diameter than an area of the guide member in which said guide portions formed.

10. An electromagnetic fuel injection valve according to claim 7 wherein said opposing portion is formed in an area of said guide member having a larger internal diameter than an area of the guide member in which said guide portion is formed.

11. An electromagnetic fuel injection valve according to claim 1 wherein said guide portion and said opposing portion are formed adjacent to one another in said guide member.

12. An electromagnetic fuel injection valve according to claim 11 wherein said opposing portion is formed in an area of said guide member having a larger internal diameter than an area of the guide member in which said guide portion is formed.

13. An electromagnetic fuel injection valve according to claim 1 wherein said opposing portion is formed in an area of said guide member having a larger internal diameter than an area of the guide member in which said guide portion is formed.

* * * * *